US007404230B1

(12) United States Patent
Phillips

(10) Patent No.: US 7,404,230 B1
(45) Date of Patent: Jul. 29, 2008

(54) VACUUM-OPERABLE FECES COLLECTOR

(76) Inventor: Mary Ellen Phillips, 7390 S. County Rd. 750 E., Plainfield, IN (US) 46168

( * ) Notice: Subject to any disclaimer, the term of this patent is extended or adjusted under 35 U.S.C. 154(b) by 703 days.

(21) Appl. No.: 10/977,900

(22) Filed: Nov. 1, 2004

(51) Int. Cl.
*A47L 5/24* (2006.01)

(52) U.S. Cl. ..... 15/344; 15/324; 15/353; 15/330

(58) Field of Classification Search ..... 15/320, 15/344, 340, 2, 339, 352, 353, 330, 324; 294/1.4, 1.3
See application file for complete search history.

(56) References Cited

U.S. PATENT DOCUMENTS 4,478,448 A * 10/1984 Albert ..... 294/1.4
4,570,286 A 2/1986 Ross
D315,234 S 3/1991 Frisell
5,504,412 A * 4/1996 Chan et al. ..... 15/339
5,603,139 A * 2/1997 Alazet ..... 15/320
5,661,873 A * 9/1997 Karet ..... 15/344
5,771,531 A * 6/1998 Swartz ..... 15/344
6,115,879 A 9/2000 Mitchell
2003/0046789 A1 * 3/2003 Tingle ..... 15/340.2

* cited by examiner

*Primary Examiner*—Lee D Wilson

(57) ABSTRACT

A vacuum-operable feces collector includes a primary housing having an outer wall for defining a cavity therein. The housing further has a rear portion provided with a plurality of vents. The device further includes a vacuum mechanism for collecting the excrement from a support surface. Such a vacuum mechanism includes an elongated hose and further includes a cage removably positionable within the auxiliary housing and a motor and a rotary fan operably connected thereto. The motor and the fan are housed within the cage wherein the cage has a plurality of outlet openings and an inlet port disposed upstream therefrom for assisting the fan to direct air outwardly from the auxiliary housing. A storing mechanism is operably connected to the vacuum mechanism and includes a disposable bag removably connected to the hose.

16 Claims, 3 Drawing Sheets

VACUUM-OPERABLE FECES COLLECTOR

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to excrement removal devices and, more particularly, to a vacuum-operable excrement collector.

2. Prior Art

It will be appreciated that in an urban environment, animal excrement has become an increasingly serious problem and a number of municipalities have enacted "curb your dog" ordinances not only requiring that animals be walked on leashes in the streets, but that their owners assume responsibility for removal of their animal's excrement from the street. For example, New York City has enacted legislation requiring a dog owner to remove the dog's excrement from the street or be fined for failure to comply.

Accordingly, a number of commercially available devices have been developed and marketed to assist an animal owner in removing his animal's excrement from city streets. Such devices include, for example, chemical devices to chemically decompose the fecal matter as well as other hand held or wheeled devices for scraping or shoveling it up into containers. Such prior art devices present a number of disadvantages including, for example, extreme bulkiness, or they require the owner to physically handle the animal's excrement in order to dispose of it.

Accordingly, a need remains for a hand-held, vacuum-operable feces collection device wherein the excrement is drawn into an excrement containing housing by suction generated by the device. The present invention satisfies such a need and is readily capable of being operated and carried by an animal owner and further includes a disposable bag in the housing for easy disposal by the owner. Thus, the present invention provides a pet owner with a practical, convenient, and sanitary method of collecting pet feces.

BRIEF SUMMARY OF THE INVENTION

In view of the foregoing background, it is therefore an object of the present invention to provide a portable vacuum-operable feces collector. These and other objects, features, and advantages of the invention are provided by a device for collecting and disposing of animal excrements. Such a device includes a primary housing having an outer wall for defining a cavity therein. The outer wall has top and front portions provided with a plurality of openings spaced therealong respectively. The housing further has a rear portion provided with a plurality of vents for allowing air to pass therethrough. The primary housing further includes a flexible strap having opposed end portions attached to the top portion thereof for assisting a user to maneuver the device.

The device preferably further includes an auxiliary housing removably attachable to the primary housing and extending forwardly therefrom. The auxiliary housing has an outer wall provided with an opening for allowing exhaust to escape therefrom and includes a grill mated into the opening thereof for blocking selected debris from passing therethrough. A plurality of latches preferably lock the auxiliary housing to the primary housing.

The device preferably further includes a vacuum mechanism for collecting the excrement from a support surface. Such a vacuum mechanism preferably includes an elongated hose passing through the auxiliary housing and having opposed end portions positioned exterior of the auxiliary housing and within the cavity. The hose preferably includes a flared nozzle attached thereto for assisting a user to collect the excrement.

The vacuum mechanism preferably further includes a cage removably positionable within the auxiliary housing and a motor and a rotary fan operably connected thereto. The motor and the fan are housed within the cage wherein the cage has a plurality of outlet openings and an inlet port disposed upstream therefrom for assisting the fan to direct air outwardly from the auxiliary housing during operating conditions. A filter may be disposed within the auxiliary housing and downstream of the fan such that undesirable odors can be blocked from exiting the device. A switch is electrically coupled to the motor and protrudes outwardly from one of the primary housing openings for allowing a user to readily toggle the device between operable and non-operable modes.

A storing mechanism for holding the excrement therein is operably connected to the vacuum mechanism. Such a storage mechanism preferably includes a disposable bag removably connected to the hose and in fluid communication therewith for receiving the excrement during operating conditions. The device preferably further includes a mechanism for supplying power to the vacuum mechanism and the storing mechanism.

The power supply mechanism preferably includes an internal battery pack housed adjacent the vents of the primary housing and a plurality of conductive terminals electrically connected to the battery pack. Such a power supply mechanism preferably further includes a base member including a plurality of contacts associated with the conductive terminals and electrically mateable therewith such that the battery pack can be recharged when the base member is inserted into a power outlet.

The storing mechanism preferably further includes a mechanism for separating and sealing the bag from the hose. Such a separating and sealing mechanism preferably includes a plurality of arms pivotally connected to the hose for defining finger-like levers engageable about an opening of the bag and for selectively pinching and sealing the bag opening during non-operating conditions. An air-intake valve is operably attached to the hose and upstream of the arms. Such a valve is selectively adaptable between engaged and disengaged positions for preventing and allowing air to flow inwardly into the cavity when the vacuum mechanism is activated such that stagnant air can be effectively extracted outwardly from the bag before a user detaches the bag from the hose. A switch is electrically coupled to the arms and extends upwardly from another of the primary housing openings.

The device preferably further includes a conduit having opposed end portions in fluid communication with the hose and being situated exterior of the auxiliary housing respectively. The conduit preferably includes an end cap removably positionable on one of the conduit end portions for preventing fluids and debris from exiting therethrough. The conduit receives a water supply source therein and directs water into the primary housing such that the cavity can be periodically flushed and cleaned during non-operating conditions.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
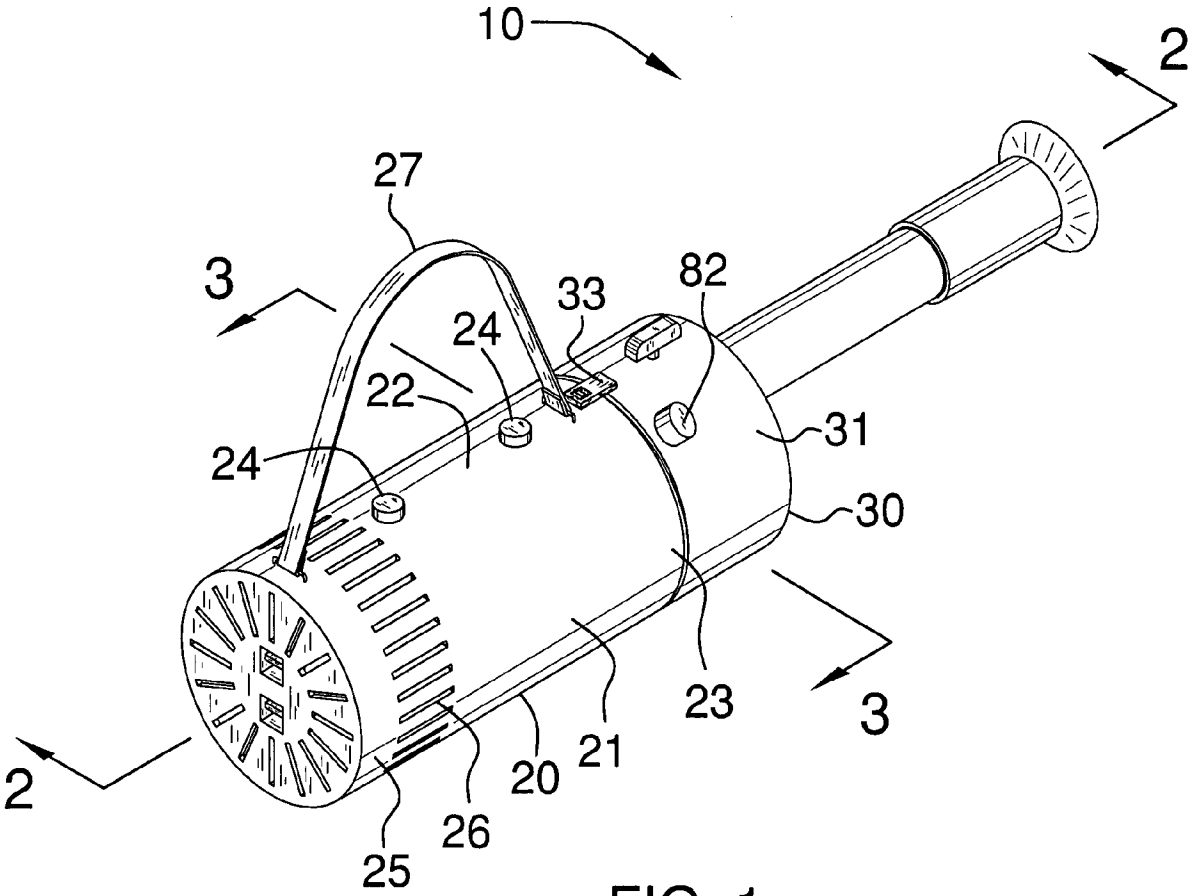
FIG. 1 is a perspective view showing a vacuum-operable feces collector, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-4 by the reference numeral 10 and is intended to provide a portable vacuum-operable feces collector. It should be understood that the device 10 may be used to collect many different types of small objects and should not be limited to only the collection of feces.

Initially referring to FIG. 1, the device 10 includes a primary housing 20 having an outer wall 21 for defining a cavity therein. The outer wall 21 has top 22 and front 23 portions provided with a plurality of openings 24 spaced therealong respectively. The housing 20 further has a rear portion 25 provided with a plurality of vents 26 for allowing air to pass therethrough. The primary housing 20 further includes a flexible strap 27 having opposed end portions attached to the top portion 22 thereof for assisting a user to maneuver the device. Such a strap 27 fits conveniently over a user's shoulder for easy transportation. The strap 27 could also be easily grasped by a user's hand when reaching for feces to be collected, thus preventing elderly or obese persons from having to bend over and risk straining their back.

Figure 4:
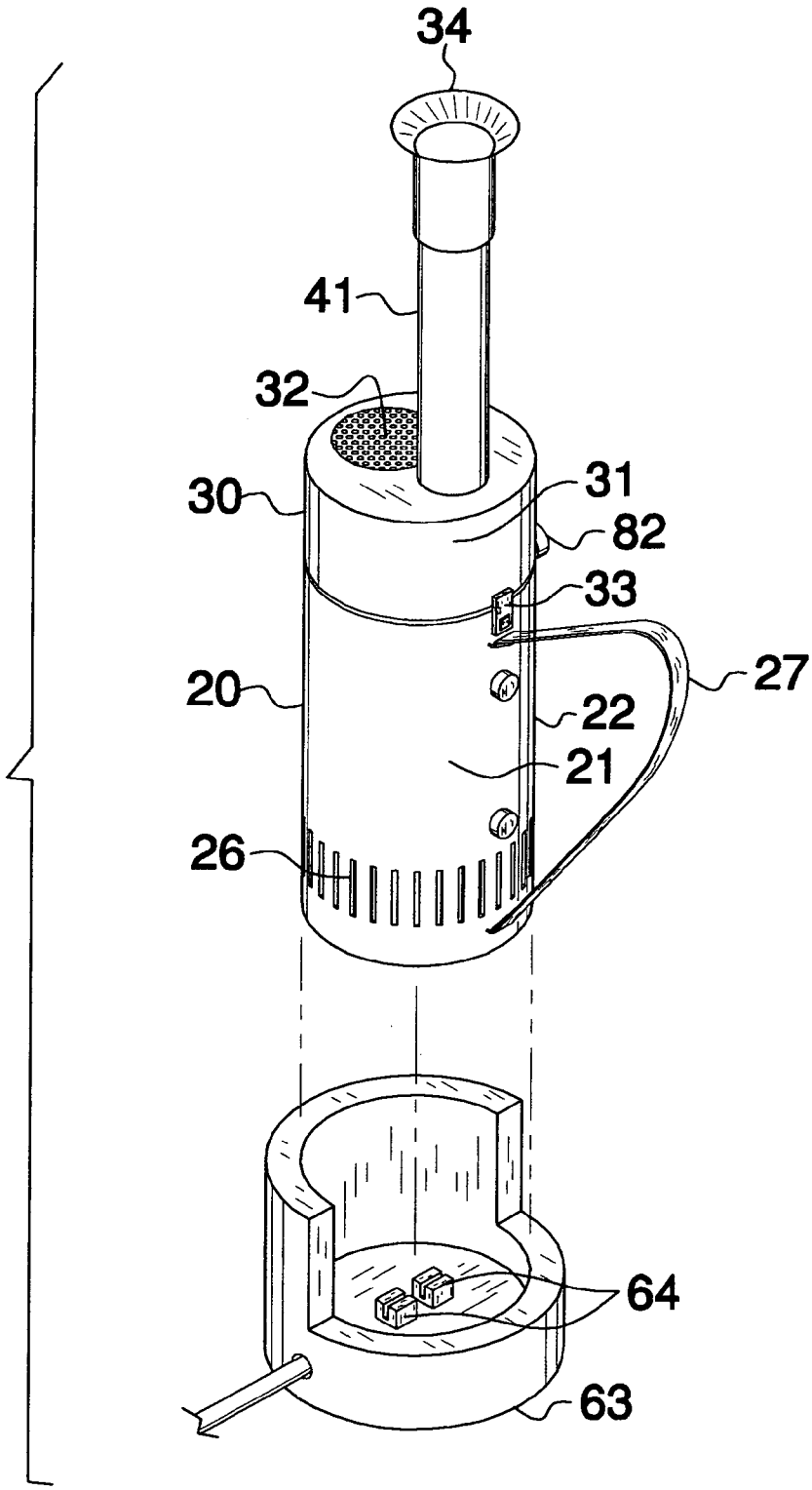
FIG. 4 is a partially exploded view of the present invention illustrating the placement of the housing on the power supply mechanism for recharging.

Referring to FIGS. 1 and 4, the device 10 preferably further includes an auxiliary housing 30 removably attachable to the primary housing 20 and extending forwardly therefrom. The auxiliary housing 30 has an outer wall 31 provided with an opening for allowing exhaust to escape therefrom and includes a grill 32 mated into the opening thereof for blocking selected debris from passing therethrough, as best shown in FIG. 4. The grill 32 prevents leaves, pebbles, and other debris from entering the auxiliary housing 30 and causing damage to internal components located therein. A plurality of latches 33 preferably lock the auxiliary housing 30 to the primary housing 20. The latches 33 are easily opened so a user can remove the auxiliary housing 30 for cleaning or to dispose of excrement collected.

Figure 2:
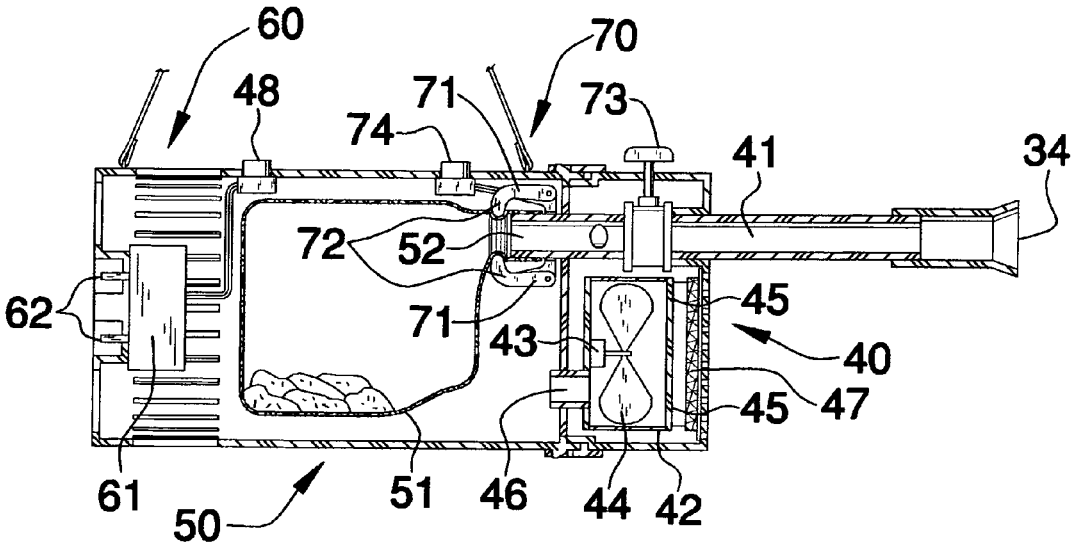
FIG. 2 is a cross-sectional view of the present invention shown in FIG. 1, taken along line 2-2.

Now referring to FIG. 2, the device 10 preferably further includes a vacuum mechanism 40 for collecting the excrement from a support surface. Such a vacuum mechanism 40 preferably includes an elongated hose 41 passing through the auxiliary housing 30 and having opposed end portions positioned exterior of the auxiliary housing 30 and within the cavity. The hose 41 preferably includes a flared nozzle 34 attached thereto for assisting a user to collect the excrement. The flared nozzle 34 ensures that all parts of the excrement to be collected enter the hose 41.

Still referring to FIG. 2, the vacuum mechanism 40 preferably further includes a cage 42 removably positionable within the auxiliary housing 30 and a motor 43 and a rotary fan 44 operably connected thereto. The motor 43 and the fan 44 are housed within the cage 42 wherein the cage 42 has a plurality of outlet openings 45 and an inlet port 46 disposed upstream therefrom for assisting the fan 44 to direct air outwardly from the auxiliary housing 30 during operating conditions. A filter 47 may be disposed within the auxiliary housing and downstream of the fan such that undesirable odors can be blocked from exiting the device 10. The filter 47 enables a user to work for a longer period of time than may comfortably be possible if such odors were not suppressed. A switch 48 is electrically coupled to the motor 43 and protrudes outwardly from one of the primary housing openings 24 for allowing a user to readily toggle the device 10 between operable and non-operable modes.

Still referring to FIG. 2, a storing mechanism 50 for holding the excrement therein is operably connected to the vacuum mechanism 40. Such a storage mechanism 50 preferably includes a disposable bag 51 removably connected to the hose 41 and in fluid communication therewith for receiving the excrement during operating conditions. Advantageously, the disposable bag 51 ensures that a user does not have to handle the collected excrement with his/her hands, thus eliminating contact with germs and other unsanitary items collected therein. The device 10 preferably further includes a mechanism 60 for supplying power to the vacuum mechanism 40 and the storing mechanism 50.

Still referring to FIG. 2, the power supply mechanism 60 preferably includes an internal battery pack 61 housed adjacent the vents 26 of the primary housing 20 and a plurality of conductive terminals 62 electrically connected to the battery pack 61. Such a power supply mechanism 60 preferably further includes a base member 63 including a plurality of contacts 64 associated with the conductive terminals 62 and electrically mateable therewith such that the battery pack 61 can be recharged when the base member 63 is inserted into a power outlet. The rechargeable feature of the device 10 advantageously allows a user to carry the device 10 without worrying about a trailing electrical cord and further allows a user to go on longer walks with the pet than would otherwise be possible. When the walk is over, a user may simply place the device 10 on the base member 63 for recharging, as shown in FIG. 4.

Still referring to FIG. 2, the storing mechanism 50 preferably further includes a mechanism 70 for separating and sealing the bag 51 from the hose 41. Such a separating and sealing mechanism 70 preferably includes a plurality of arms 71 pivotally connected to the hose 41 for defining finger-like levers 72 engageable about an opening 52 of the bag 51 and for selectively pinching and sealing the bag opening 52 during non-operating conditions.

An air-intake valve 73 is operably attached to the hose 41 and upstream of the arms 71. Such a valve 73 is selectively adaptable between engaged and disengaged positions for preventing and allowing air to flow inwardly into the cavity when the vacuum mechanism 40 is activated such that stagnant air can be effectively extracted outwardly from the bag 51 before a user detaches the bag 51 from the hose 41.

A switch 74 is electrically coupled to the arms 71 and extends upwardly from another of the primary housing 20 openings. The sealing and separating mechanism 70 advantageously eliminates all contact with the collected excrement, allaying any fears a user may have of receiving germs from contact therewith. It further eliminates the need for a user to wear rubber gloves or other protective clothing.

Figure 3:
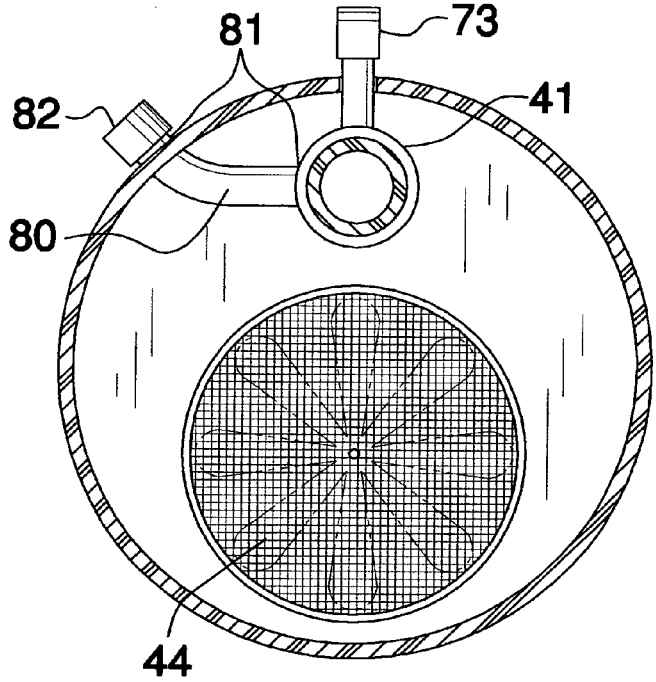
FIG. 3 is a cross-sectional view of the vacuum mechanism, taken along line 3-3.

Now referring to FIG. 3, the device 10 preferably further includes a conduit 80 having opposed end portions 81 in fluid communication with the hose 41 and being situated exterior of the auxiliary housing 30 respectively. The conduit 80 preferably includes an end cap 82 removably positionable on one of the conduit end portions 81 for preventing fluids and debris from exiting therethrough. The conduit 80 receives a water supply source therein and directs water into the primary housing 20 such that the cavity can be periodically flushed and cleaned during non-operating conditions. Advantageously, the conduit 80 is readily attachable to a common garden hose as well known in the industry when the end cap 82 is removed so a user can flush the interior of the device 10 on a regular basis.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A device for collecting and disposing of animal excrements, said device comprising:

a primary housing having an outer wall for defining a cavity therein, said outer wall having top and front portions provided with a plurality of openings spaced therealong respectively, said housing further having a rear portion provided with a plurality of vents for allowing air to pass therethrough;

an auxiliary housing removably attachable to said primary housing and extending forwardly therefrom, said auxiliary housing having an outer wall provided with an opening for allowing exhaust to escape therefrom;

vacuum means for collecting the excrements from a support surface, said vacuum means comprising an elongated hose passing through said auxiliary housing and having opposed end portions positioned exterior of said auxiliary housing and within the cavity;

storing means for holding the excrements therein, said storing means being operably connected to said vacuum means, said storage means comprising a disposable bag removably connected to said hose and being in fluid communication therewith for receiving the excrements during operating conditions; and means for supplying power to said vacuum means and said storing means;

wherein said vacuum means further comprises:

a cage removably positionable within said auxiliary housing;

a motor and a rotary fan operably connected thereto, said motor and said fan being housed within said cage wherein said cage has a plurality of outlet openings and an inlet port disposed upstream therefrom for assisting said fan to direct air outwardly from said auxiliary housing during operating conditions;

a filter disposed within said auxiliary housing and downstream of said fan such that undesirable odors can be blocked from exiting said device; and a switch electrically coupled to said motor, said switch protruding outwardly from one said primary housing openings for allowing a user to readily toggle said device between operable and non-operable modes.

2. The device of claim 1, wherein said storing means further comprises:

means for separating and sealing said bag from said hose, said separating and sealing means comprising a plurality of arms pivotally connected to said hose for defining levers engageable about an opening of said bag and for selectively pinching and sealing said bag opening during non-operating conditions;

an air-intake valve operably attached to said hose and upstream of said arms, said valve being selectively adaptable between engaged and disengaged positions for preventing and allowing air to flow inwardly into the cavity when said vacuum means is activated such that stagnant air can be effectively extracted outwardly from said bag before a user detaches said bag from said hose; and a switch electrically coupled to said arms and extending upwardly from another said primary housing openings.

3. The device of claim 1, further comprising: a plurality of latches for locking said auxiliary housing to said primary housing.

4. The device of claim 1, wherein said power supply means comprises:

an internal battery pack housed adjacent the vents of said primary housing;

a plurality of conductive terminals electrically connected to said battery pack;

a base member including a plurality of contacts associated with said conductive terminals and electrically mateable therewith such that said battery pack can be recharged when said base member is inserted into a power outlet.

5. The device of claim 1, further comprising: a conduit having opposed end portions in fluid communication with said hose and being situated exterior of said auxiliary housing respectively, said conduit including on end cap removably positionable on one said conduit end portions for preventing fluids and debris from exiting therethrough, said conduit for receiving a water supply source therein and for directing water into said primary housing such that the cavity can be periodically flushed and cleaned during non-operating conditions.

6. A device for collecting and disposing of animal excrements, said device comprising:

a primary housing having an outer wall for defining a cavity therein, said outer wall having top and front portions provided with a plurality of openings spaced therealong respectively, said housing further having a rear portion provided with a plurality of vents for allowing air to pass therethrough;

an auxiliary housing removably attachable to said primary housing and extending forwardly therefrom, said auxiliary housing having an outer wall provided with an opening for allowing exhaust to escape therefrom, said auxiliary housing including a grill mated into the opening thereof for blocking selected debris from passing therethrough;

vacuum means for collecting the excrements from a support surface, said vacuum means comprising an elongated hose passing through said auxiliary housing and having opposed end portions positioned exterior of said auxiliary housing and within the cavity, said hose including a flared nozzle attached thereto for assisting a user to collect the excrements;

storing means for holding the excrements therein, said storing means being operably connected to said vacuum means, said storage means comprising a disposable bag removably connected to said hose and being in fluid communication therewith for receiving the excrements during operating conditions; and means for supplying power to said vacuum means and said storing means;

wherein said vacuum means further comprises:

a cage removably positionable within said auxiliary housing;

a motor and a rotary fan operably connected thereto, said motor and said fan being housed within said cage wherein said cage has a plurality of outlet openings and an inlet port disposed upstream therefrom for assisting said fan to direct air outwardly from said auxiliary housing during operating conditions;

a filter disposed within said auxiliary housing and downstream of said fan such that undesirable odors can be blocked from exiting said device; and a switch electrically coupled to said motor, said switch protruding outwardly from one said primary housing openings for allowing a user to readily toggle said device between operable and non-operable modes.

7. The device of claim 6, wherein said storing means further comprises:

means for separating and sealing said bag from said hose, said separating and sealing means comprising a plurality of arms pivotally connected to said hose for defining levers engageable about an opening of said bag and for selectively pinching and sealing said bag opening during non-operating conditions;

an air-intake valve operably attached to said hose and upstream of said arms, said valve being selectively adaptable between engaged and disengaged positions for preventing and allowing air to flow inwardly into the cavity when said vacuum means is activated such that stagnant air can be effectively extracted outwardly from said bag before a user detaches said bag from said hose; and a switch electrically coupled to said arms and extending upwardly from another said primary housing openings.

8. The device of claim 6, further comprising: a plurality of latches for locking said auxiliary housing to said primary housing.

9. The device of claim 6, wherein said power supply means comprises;

an internal battery pack housed adjacent the vents of said primary housing;

a plurality of conductive terminals electrically connected to said battery pack;

a base member including a plurality of contacts associated with said conductive terminals and electrically mateable therewith such that said battery pack can be recharged when said base member is inserted into a power outlet.

10. The device of claim 6, further comprising: a conduit having opposed end portions in fluid communication with said hose and being situated exterior of said auxiliary housing respectively, said conduit including an end cap removably positionable on one said conduit end portions for preventing fluids and debris from exiting therethrough, said conduit for receiving a water supply source therein and for directing water into said primary housing such that the cavity can be periodically flushed and cleaned during non-operating conditions.

11. A device for collecting and disposing of animal excrements, said device comprising:

a primary housing having an outer wall for defining a cavity therein, said outer wall having top and front portions provided with a plurality of openings spaced therealong respectively, said housing further having a rear portion provided with a plurality of vents for allowing air to pass therethrough, said primary housing further including a flexible strap having opposed end portions attached to said top portion thereof for assisting a user to maneuver said device;

an auxiliary housing removably attachable to said primary housing and extending forwardly therefrom, said auxiliary housing having an outer wall provided with an opening for allowing exhaust to escape therefrom, said auxiliary housing including a grill mated into the opening thereof for blocking selected debris from passing therethrough;

vacuum means for collecting the excrements from a support surface, said vacuum means comprising an elongated hose passing through said auxiliary housing and having opposed end portions positioned exterior of said auxiliary housing and within the cavity, said hose including a flared nozzle attached thereto for assisting a user to collect the excrements;

storing means for holding the excrements therein, said storing means being operably connected to said vacuum means, said storage means comprising a disposable bag removably connected to said hose and being in fluid communication therewith for receiving the excrements during operating conditions; and means for supplying power to said vacuum means and said storing means.

12. The device of claim 11, wherein said vacuum means further comprises:

a cage removably positionable within said auxiliary housing;

a motor and a rotary fan operably connected thereto, said motor and said fan being housed within said cage wherein said cage has a plurality of outlet openings and an inlet port disposed upstream therefrom for assisting said fan to direct air outwardly from said auxiliary housing during operating conditions;

a filter disposed within said auxiliary housing and downstream of said fan such that undesirable odors can be blocked from exiting said device; and a switch electrically coupled to said motor, said switch protruding outwardly from one said primary housing openings for allowing a user to readily toggle said device between operable and non-operable modes.

13. The device of claim 11, wherein said storing means further comprises:

means for separating and sealing said bag from said hose, said separating and sealing means comprising a plurality of arms pivotally connected to said hose for defining levers engageable about an opening of said bag and for selectively pinching and sealing said bag opening during non-operating conditions;

an air-intake valve operably attached to said hose and upstream of said arms, said valve being selectively adaptable between engaged and disengaged positions for preventing and allowing air to flow inwardly into the cavity when said vacuum means is activated such that stagnant air can be effectively extracted outwardly from said bag before a user detaches said bag from said hose; and a switch electrically coupled to said arms and extending upwardly from another said primary housing openings.

14. The device of claim 11, further comprising: a plurality of latches for locking said auxiliary housing to said primary housing.

15. The device of claim 11, wherein said power supply means comprises:

an internal battery pack housed adjacent the vents of said primary housing;

a plurality of conductive terminals electrically connected to said battery pack;

a base member including a plurality of contacts associated with said conductive terminals and electrically mateable therewith such that said battery pack can be recharged when said base member is inserted into a power outlet.

16. The device of claim 11, further comprising: a conduit having opposed end portions in fluid communication with said hose and being situated exterior of said auxiliary housing respectively, said conduit including an end cap removably positionable on one said conduit end portions for preventing fluids and debris from exiting therethrough, said conduit for receiving a water supply source therein and for directing water into said primary housing such that the cavity can be periodically flushed and cleaned during non-operating conditions.

* * * * *